US008529659B2

(12) United States Patent
Streib et al.

(10) Patent No.: US 8,529,659 B2
(45) Date of Patent: Sep. 10, 2013

(54) DIAGNOSIS OF THE OPERABILITY OF FUEL VAPOUR INTERMEDIATE STORES

(75) Inventors: Martin Streib, Vaihingen (DE); Andreas Pape, Oberriexingen (DE); Andreas Baumann, Vaihingen/Enz (DE); Werner Haeming, Neudenau (DE)

(73) Assignee: Robert Bosch GmbH, Stuttgart (DE)

( * ) Notice: Subject to any disclaimer, the term of this patent is extended or adjusted under 35 U.S.C. 154(b) by 232 days.

(21) Appl. No.: 12/990,360

(22) PCT Filed: Nov. 28, 2008

(86) PCT No.: PCT/EP2008/066402

§ 371 (c)(1),
(2), (4) Date: Jan. 19, 2011

(87) PCT Pub. No.: WO2009/132718

PCT Pub. Date: Nov. 5, 2009

(65) Prior Publication Data

US 2011/0100210 A1 May 5, 2011

(30) Foreign Application Priority Data

Apr. 29, 2008 (DE) ..... 10 2008 001 447

(51) Int. Cl.
*F02M 25/08* (2006.01)

(52) U.S. Cl.
USPC .... 95/1; 95/146; 96/109; 123/518; 73/114.39

(58) Field of Classification Search
USPC ..... 95/8, 11, 14, 19, 143, 146; 96/109, 96/111–113; 123/518–519; 73/114.38, 114.39
See application file for complete search history.

(56) References Cited

U.S. PATENT DOCUMENTS

| | | | | |
|---|---|---|---|---|
| 5,113,834 | A | 5/1992 | Aramaki | |
| 5,150,689 | A | 9/1992 | Yano et al. | |
| 5,707,430 | A * | 1/1998 | Hara et al. | 96/111 |
| 5,921,222 | A | 7/1999 | Freeland | |
| 6,651,491 | B2 * | 11/2003 | Saito et al. | 73/114.38 |
| 6,695,895 | B2 * | 2/2004 | Hyodo et al. | 96/111 |
| 6,874,485 | B2 * | 4/2005 | Fujimoto | 123/520 |
| 7,165,447 | B2 * | 1/2007 | Miyahara et al. | 73/114.39 |
| 7,233,845 | B2 * | 6/2007 | Veinotte | 701/34.4 |
| 8,099,999 | B2 * | 1/2012 | Nakano | 73/114.39 |
| 2004/0129257 | A1 | 7/2004 | Konishi et al. | |

FOREIGN PATENT DOCUMENTS

| | | |
|---|---|---|
| DE | 44 08 647 | 9/1994 |
| DE | 199 35 886 | 2/2000 |
| JP | 4298675 | 10/1992 |
| JP | 5-180093 | 7/1993 |
| JP | 11-343925 | 12/1999 |

(Continued)

*Primary Examiner* — Frank Lawrence, Jr.

(74) *Attorney, Agent, or Firm* — Merchant & Gould P.C.

(57) ABSTRACT

A method is provided for diagnosing the operability of fuel vapor intermediate stores (4), in particular of activated carbon filters, in tank-venting systems with at least one tank (3) and at least one fuel vapor intermediate store (4). In this case an actual change degree of filling of the fuel vapor intermediate store (4) is determined as a consequence of absorption or desorption processes of gaseous hydrocarbons in the fuel vapor intermediate store (4). The actual change in degree of filling is compared with a desired change in degree of filling and, from the comparison, a conclusion about the operability of the fuel vapor intermediate store (4) is drawn.

20 Claims, 3 Drawing Sheets

(56) References Cited

FOREIGN PATENT DOCUMENTS

| | | |
|---|---|---|
| JP | 2002276477 | 9/2002 |
| JP | 2004-353555 | 12/2004 |
| WO | WO 2004/083617 | 9/2004 |
| WO | WO 2004/083619 | 9/2004 |

* cited by examiner

State of Technology

DIAGNOSIS OF THE OPERABILITY OF FUEL VAPOUR INTERMEDIATE STORES

This application is a National Stage Application of PCT/EP2008/066402, filed 28 Nov. 2008, which claims benefit of Serial No. 10 2008 001 447.8, filed 29 Apr. 2008 in Germany and which applications are incorporated herein by reference. To the extent appropriate, a claim of priority is made to each of the above disclosed applications.

BACKGROUND

The present invention relates to a method and a corresponding device for diagnosing the operability of fuel vapor intermediate stores, in particular activated carbon filters, in tank venting systems. Furthermore the present invention is subject to a computer program and a computer program product, which qualify for the implementation of the method.

Fuel vapors occur from the fuel container or tank at motor vehicles. In order to avoid an emission of these volatile hydrocarbons from the tank in particular at motor vehicles with Otto-engines or to limit it, usually devices for catching the fuel vapors, so-called fuel vapor intermediate stores, are provided. An activated carbon filter (AKF) or an activated carbon container is usually provided for this purpose. The ventilation line of the fuel container runs into this activated carbon filter. A further line goes from the activated carbon filter to the inlet manifold of the engine. A tank venting valve (regenerating valve) is generally provided in this line.

The activated carbon absorbs the fuel or the volatile hydrocarbons that are contained in the fuel vapor. For regenerating or flushing the activated carbon filter the tank venting valve is opened, so that the line between the activated carbon container and the inlet manifold is free. Due to the negative pressure that exists in the inlet manifold fresh air is sucked in through the activated carbon. The fresh air takes in the absorbed fuel in the flush current and supplies it to the combustion in the engine. By using a regular regeneration of the activated carbon the activated carbon filter remains absorbable for new evaporating fuel.

The fuel vapor intermediate store or the activated carbon filter is a central emission-relevant component in the tank system. The activated carbon filter allows to limit emissions, which are caused by the evaporation of fuel or gasoline from the fuel container or to comply with statutory emission thresholds for evaporation losses. Therefore an operative activated carbon filter is required with a corresponding storage capacity.

But there is the problem that an activated carbon filter can have an impaired operability. The activated carbon filter can for example be flooded with liquids, in particular liquid hydrocarbons or fuel. Thereby the absorption capacity for volatile hydrocarbons sinks drastically and liquid fuel might leak. A regeneration of a partially or completely flooded activated carbon filter requires a long period of time. During this period of time the operability is strongly limited. Furthermore the activated carbon can be partially or completely overlaid by nonvolatile parts of the fuel. The storage capacity of the activated carbon filter sinks then significantly and the operability of the activated carbon filter is limited permanently. In other cases the activated carbon can be damaged for example by a mechanical load, for example by commotions, so that a reduction of the storage capacity also occurs here as well as a limitation of the operability of the activated carbon filter.

Thus there is the need to control the operability of the fuel vapor intermediate store or the activated carbon filter and to carry out a diagnosis of the activated carbon filter.

Different methods are already known, which determine the load status of an activated carbon filter. This determination takes place with the aim to optimize the regeneration of the activated carbon in particular with regard to the frequency of the regeneration runs. The published patent application DE 199 35 886 A1 describes for example a control system for the vapor recirculation at engines with a direct injection. The flushing of the activated carbon filter or the vapor recirculation is usually not possible at engines with direct injection during the operation in shift-mode. Therefore the engine has to work in homogenous mode in regular intervals in order to carry out the flushing. The operation in shift-mode, which is advantageous with regard to the fuel consumption, is limited by the required flushing of the activated carbon container. Therefore the load status of the activated carbon filter is determined according to DE 199 35 886 A1 in order to minimize the frequency of the flushing processes. Therefore a vapor sensor container that is filled with activated carbon is equipped with temperature sensors, which allow a determination of the hydrocarbon concentration in the vapor recirculation system by measured temperature differences.

The publication of the Japanese patent application JP 2004 35 35 55 A describes the use of weight sensors, vapor pressure sensors and vapor temperature sensors, in order to check the absorption status in an activated carbon filter.

The international publication WO2004/083619 A1 also describes the use of temperature sensors in order to determine the degree of saturation of an activated carbon filter.

With these familiar methods statements about the load status of the activated carbon filter in the tank venting system of a motor vehicle can be made. But it is not possible to check the operability of the activated carbon filter with these methods. It can for example not be checked with these methods, whether parts of the activated carbon are permanently overlaid with nonvolatile parts of fuel, whereby the operability of the activated carbon filter is limited in the long run. The invention has therefore the task to provide a procedure for checking or diagnosing the operability of fuel vapor intermediate stores in tank venting systems. By ensuring an operative fuel vapor intermediate store it can be guaranteed that the environment is protected from fuel vapor emissions. Additionally the diagnosis of the fuel vapor intermediate store, being an emission-relevant component, shall be enabled, as it might become a statutory requirement in the future.

SUMMARY

According to the invention the method allows a diagnosis of the operability of fuel vapor intermediate stores, in particular activated carbon filters, in tank venting systems with at least one tank and at least one fuel vapor intermediate store by initially determining an actual filling degree change of the fuel vapor intermediate store due to adsorption or desorption processes of gaseous hydrocarbons in the fuel vapor intermediate store. The determined actual filling degree change is compared with a nominal filling degree change and the operability of the fuel vapor intermediate store is concluded from the comparison. The determined actual filling degree change provided a measure for the present storage capacity of the fuel vapor intermediate store. Due to the comparison with a suitable nominal filling degree change or reference storage capacity it can be determined whether the storage capacity that is required for the operability of the fuel vapor intermediate store is provided sufficiently.

That way it can be determined whether the required storage capacity of the activated carbon filter is completely, partially or not present anymore. If the present storage capacity or the determined actual filling degree change falls below a certain threshold or provides a certain delta as opposed to the nominal filling degree change, the operability of the fuel vapor intermediate store that is not present anymore or not sufficient can be concluded, so that a corresponding error message or an error input in the motor vehicle control can for example be caused.

The method is based on a high filling degree of the fuel vapor intermediate store before the beginning of desorption processes and detects a filling degree change due to a desorption of hydrocarbons in a particularly preferred embodiment of the method according to the invention. The method is hereby implemented at operating parameters, which indicate a filled fuel vapor intermediate store or a filled activated carbon filter. Advantageously a good selectivity of the method according to the invention is achieved that way. It can be assumed at a high filling degree of the fuel vapor intermediate store that the entirely present storage capacity of the fuel vapor intermediate store is mostly utilized. After a preferably complete desorption of the hydrocarbons from the activated carbon advantageously the entirely present storage capacity of the fuel vapor intermediate store can thus be determined. The method according to the invention can particularly advantageously take place for example after refueling the motor vehicle, whereby the fuel vapor intermediate store is generally filled up high after the refueling. The method according to the invention is preferably carried out after a certain waiting time after refueling in order to ensure that the tank atmosphere has adjusted to its hydrocarbon percentage or that the fuel vapor intermediate store is filled correspondingly. By considering the high filling degree of the fuel vapor intermediate store as initial state a standardization of the method can for example take place so that particularly reliable statements about the storage capacity and the operability of the fuel vapor intermediate store that has to be examined can be made.

In a preferred embodiment of the method according to the invention the desorption of hydrocarbons from the fuel vapor intermediate store takes place during a venting of the tank, in particular by opening the tank venting valve. A flowing off of gaseous hydrocarbons from the fuel vapor intermediate store is caused by the negative pressure in the inlet manifold of the engine, which has an effect on the fuel vapor intermediate store by opening of the tank venting valve or the regeneration valve between the fuel vapor intermediate store and the inlet manifold. Due to this negative pressure fresh air is sucked in through the medium or bulk the of the fuel vapor intermediate store, in particular through the activated carbon. The fresh air takes in the absorbed fuel and flows over the tank venting valve to the combustion engine following the pressure incline.

The opening of the tank venting valve can be the regular opening of the tank venting valve for the required regeneration of the fuel vapor intermediate store, which is carried out during the regular operation of the motor vehicle. On the other hand it is also possible that the opening of the tank venting valve takes in particular place in order to determine the storage capacity according to the invention or to diagnose of the fuel vapor intermediate store. The opening of the tank venting valve can advantageously be controlled temporally so that a complete desorption of the fuel vapor intermediate store takes place, which means that basically the entirely absorbed hydrocarbon is released. On the other hand is can be preferred according to the invention that only a partial desorption takes place, which is temporally limited and defined. The determined actual filling degree change related to the corresponding time or the complete desorption or regeneration of the fuel vapor intermediate store is compared to a suitable reference parameter and the present storage capacity is concluded from that, which allows conclusion about the operability by a comparison with a suitable reference value for the nominal filling degree change.

When carrying out the method for comparing the actual filling degree change with a reference value or with the nominal filling degree change according to the invention it is particularly advantageously to only consider that part of hydrocarbons, which is the result of adsorption or desorption processes of hydrocarbons in the fuel vapor intermediate store, in particular at the activated carbon. This is advantageously in particular possible if the evaporation or outgasing from the tank is relatively small so that it can be neglected. If basically no evaporation or outgasing of hydrocarbons from the tank or the fuel in the tank takes place, the concentration of hydrocarbons in the flush current sinks down to approximately 0. The hydrocarbons that have flown off until this point of time have been stored in the fuel vapor intermediate store.

If an evaporation in the tank shall take place during the flushing or regeneration of the fuel vapor intermediate store it is advantageously provided to consider the evaporation of hydrocarbons accordingly. The hydrocarbon mass, which has flown off of the tank and which results in particular from the fuel evaporation during the tank venting or during the regeneration of the fuel vapor intermediate store, is preferably not taken into account at the comparison and for example considered arithmetically in these embodiments.

Status parameters in the tank and/or in the tank environment are advantageously considered, in order to determine the outgasing or evaporation of the fuel in the tank. By determining these status parameters statements are made according to the invention about the evaporated hydrocarbon masses in the tank and considered at the comparison according to the invention. The status parameters in the tank and/or in the tank environment are preferably the tank pressure, the tank filling, the tank temperature and/or the outside temperature. The consideration of these status parameters can take place on a program level and/or by a measurement with a corresponding sensor system. Alternatively or in addition to that the tank pressure can advantageously be measured, in particular the tank pressure in a closed up tank system. This can create the basis for the determination of the hydrocarbon masses depending on the evaporation in the fuel tank. The measurement of the tank pressure in this context is hereby particularly preferred since there are already suitable devices in many systems for a pressure measurement and for cordoning against the atmosphere in the tank venting systems, so that the additional costs for the method according to the invention can be kept low.

An actual filling degree change of the fuel vapor intermediate store is detected in a preferred embodiment of the method according to the invention, which occurs due to an adsorption of gaseous hydrocarbons in the fuel vapor intermediate store, in particular at the activated carbon. The method for diagnosing the operability is hereby preferably carried out at operating parameters, which characterize a low filling degree of the fuel vapor intermediate store before the beginning of the adsorption processes. The method according to the invention can for example be implemented after a regeneration of the fuel vapor intermediate store. After a regeneration it has to be assumed that the fuel vapor intermediate store is mostly emptied. An actual filling degree change can be particularly advantageously determined in these embodiments, which is based on an adsorption of hydrocarbons in the fuel vapor intermediate store at or after a refueling of the tank with fuel.

The determination of the actual filling degree change in the fuel vapor intermediate store can take place using different methods. The determination of the actual filling degree change takes place in a particularly preferred embodiment by detecting the remaining oxygen content in the exhaust gas of the combustion engine. By measuring the remaining oxygen content in the exhaust gas for example during the tank venting or the regeneration of the fuel vapor intermediate store statements can be made about the hydrocarbon content in the tank venting gases as compared to the state in regular operation of the engine. Advantageously a sensor system that already exists is therefore used in the system. The remaining oxygen content in the exhaust gas after combusting the fuel in the engine commonly clarifies the relation of air and fuel in the combustion mixture. A measuring of the oxygen content in the exhaust gas takes therefore usually place by so-called lambda probes. A corresponding lambda regulating circuit adjusts the relation of air and fuel in the combustion mixture optimally. The hydrocarbon concentration in the exhaust gas is particularly advantageously determined during the desorption or adsorption in the fuel vapor intermediate store by detecting the deviation of at least one parameter, which is controlled by the lambda regulation. The actual filling degree change can be determined with the determined concentration and the volume current. The controlling of the fuel injection amount can for example be used for that, which is regulated depending on the remaining oxygen content in the exhaust gas. The hydrocarbon mass current from the fuel mass intermediate store that has to be measured can thereby be calculated based on the deviation of the lambda regulation, whereby the fresh air mass current and the fuel mass current are known. The particular advantage of these embodiments is that existing sensor systems and control elements of the system can be used, so that no further significant costs for the implementation of the method according to the invention occur in the motor vehicle.

In a further particularly preferred embodiment of the method according to the invention the determination of the actual filling degree change takes place by detecting the temperature in the tank venting system, in particular in the fuel vapor intermediate store. Due to adsorption and desorption processes at adsorption mediums, for example at activated carbon, temperature changes in the storage and in particular in the adsorption medium are commonly caused. By detecting these temperature changes by suitable sensors conclusions can be made about the load status of the medium. This can be used according to the invention by measuring filling degree change during, before and/or after the desorption and adsorption processes by a corresponding arrangement of temperature sensors and a detection of the temperature differences.

The actual filling degree change is particularly advantageously determined at the tank venting valve in a further preferred embodiment by detecting the hydrocarbon concentration in the tank venting system. The detection of the hydrocarbon concentration takes preferably place by a usual hydrocarbon sensor.

In a further preferred embodiment the actual filling degree change is determined by detecting the weight of the fuel vapor intermediate store, in particular the activated carbon filter. The weight is preferably determined before and after the adsorption or desorption processes and he actual filling degree change is concluded from the weight difference by a comparison with suitable reference values. Common weight sensors can be used. The weight of the fuel vapor intermediate store can for example be determined by the static alignment of the position of the fuel vapor intermediate store in the gravitation field that provides the characteristics of a spring. The static alignment can for example be detected with a path sensor. In another embodiment the weight can be determined from the oscillation frequency of the excited, oscillatory, in particular elastically positioned fuel vapor intermediate store. The oscillation frequency can for example be detected with the aid of an oscillation sensor. The elastic position itself can be construed in different ways. The arrangement of the fuel vapor intermediate store can for example be laying on spring elements. Another embodiment provides an elastic hanging. The detection of the weight or the weight change advantageously allow conclusions about the possibly present filling or flooding of the activated carbon filter with liquid mediums, for example water or fuel.

The means for determining the actual filling degree change that have been described exemplary can be used for the method according to the invention individually or in combination with each other. Individual or several sensor elements can thereby be provided. The measurement advantageously takes place by using the lambda sensor system and/or the lambda regulation in combination with one or several further sensors. Due to cost considerations such embodiments according to the invention are preferred, which use already existing sensor systems of a motor vehicle. On the other hand it can also be preferred to implement the sensor system and/or controlling that is provided for the implementation of the method according to the invention newly.

The comparison of the determined actual filling degree change, which can be reduced by the hydrocarbon masses from the evaporation in the tank, with the nominal filing degree change takes place in a common control element, which can for example be a component of a control unit for the motor vehicle. According to the invention one or several nominal filling degree change values are stored as reference values, in particular saved. From the comparison of the actual filling degree change as a measure for the present storage capacity with a nominal filling degree change the operability of the fuel vapor intermediate store is concluded. One or several threshold values are advantageously provided as a measure for the required storage capacity of the fuel vapor intermediate store. When falling below one or several of these threshold values an error message is advantageously produced, which signalizes the operability of the fuel vapor intermediate store that is not present anymore or the degree of the operability.

The invention furthermore comprises a corresponding device for diagnosing the operability of fuel vapor intermediate stores in tank venting systems with at least one tank and at least one fuel vapor intermediate store. The device according to the invention provides at least one means for determining an actual filling degree change of the fuel vapor intermediate store and at least one means for comparing the actual filing degree change with a nominal filling degree change as a measure for the required storage capacity of the fuel vapor intermediate store. The means for determining the actual filling degree is advantageously a lambda probe or a lambda regulating device. Other preferred means for determining the actual filling degree change are for example temperature sensors, hydrocarbon sensors and/or weight sensors. With regard to other characteristics of the device according to the invention it is referred it to above description.

The previously described method can be advantageously implemented as a computer program, in an arithmetic unit, in particular in a control unit or an electric control unit of a motor vehicle and run there. A corresponding program code can be stored on a machine-readable carrier, which the control unit or the arithmetic unit can read. The invention comprises therefore a corresponding computer program or a computer program product with program code, which qualifies for the implementation of the described method.

Further characteristics and advantages arise from the subsequent description of the drawings in connection with the embodiments. The different characteristics can thereby be realized each by itself or in combination with each other.

DETAILED DESCRIPTION

Figure 1:
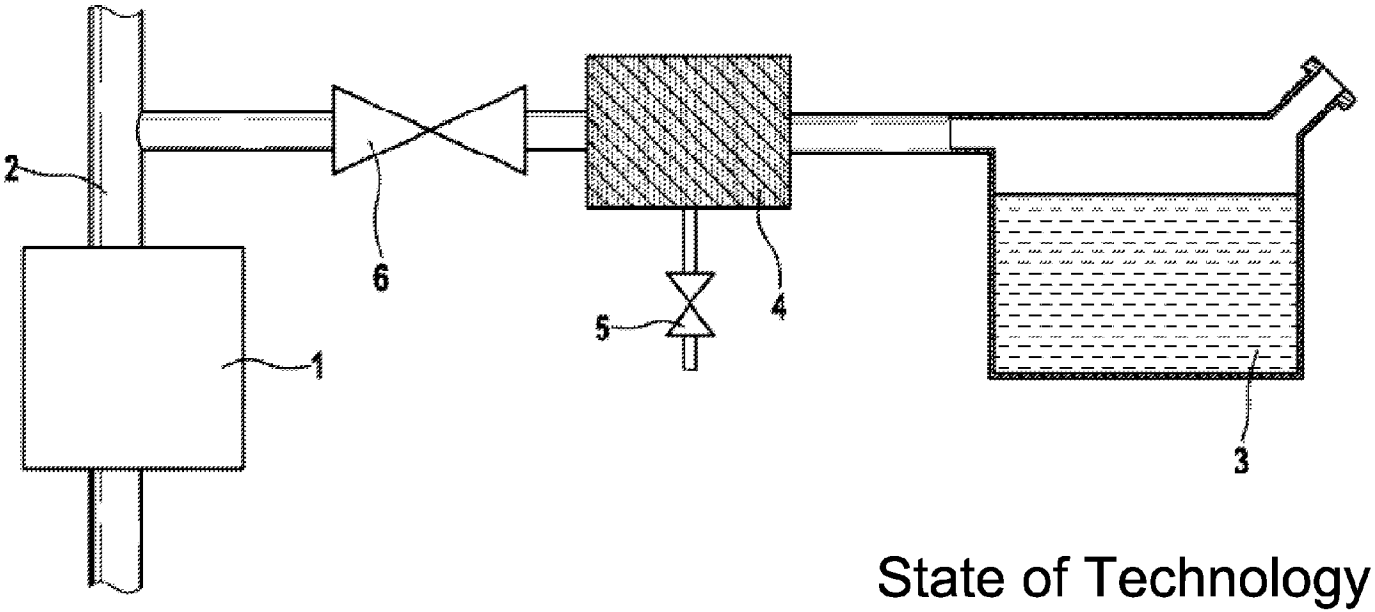
FIG. 1 an illustration of a common tank venting system at the state of the art, FIG. 2 an illustration of a tank venting system with a tank, a fuel vapor intermediate system and a sensor system for implementing preferred embodiments of the method according to the invention and FIG. 3 an illustration of a further tank venting system with a tank, a fuel vapor intermediate system and sensor system for implementing a further preferred embodiment of the method according to the invention.

FIG. 1 shows a tank venting system of the fuel supply of a combustion engine 1, which is provided for being used in a motor vehicle. The combustion engine 1 is supplied with air over the inlet manifold 2. The supply with fuel takes place from the tank 3. In order to avoid the escaping of fuel vapors from the tank 3 into the environment, a tank venting system is provided, which comprises a fuel vapor intermediate store 4 in the form of an activated carbon filter, a closing valve 5 that is arranged in the venting line of the activated carbon filter 4 and a tank venting valve 6 that is arranged between the activated carbon filter 4 and the inlet manifold 2. Volatile hydrocarbons, which result from the evaporation of the fuel in the fuel tank 3, get into the activated carbon filter 4 over a line. The volatile hydrocarbons are here adsorbed at the activated carbon. The fuel that is evaporating in the tank 3 is stored in the activated carbon filter 4. During the operation of the combustion engine 1 stored fuel or the gaseous hydrocarbons from the activated carbon filter 4 can be supplied to the combustion in the combustion engine 1 over the opened tank venting valve 6 and the inlet manifold 2. Due to the pressure relations that occur thereby the activated carbon filter 4 is simultaneously flushed with fresh air at an opened closing valve 5. Due to the negative pressure in the inlet manifold 2 the fresh air is sucked through the activated carbon in the activated carbon filter 4. The fresh air takes in the adsorbed fuel and supplies it through the inlet manifold 2 to the combustion in the combustion engine 1.

Figure 2:
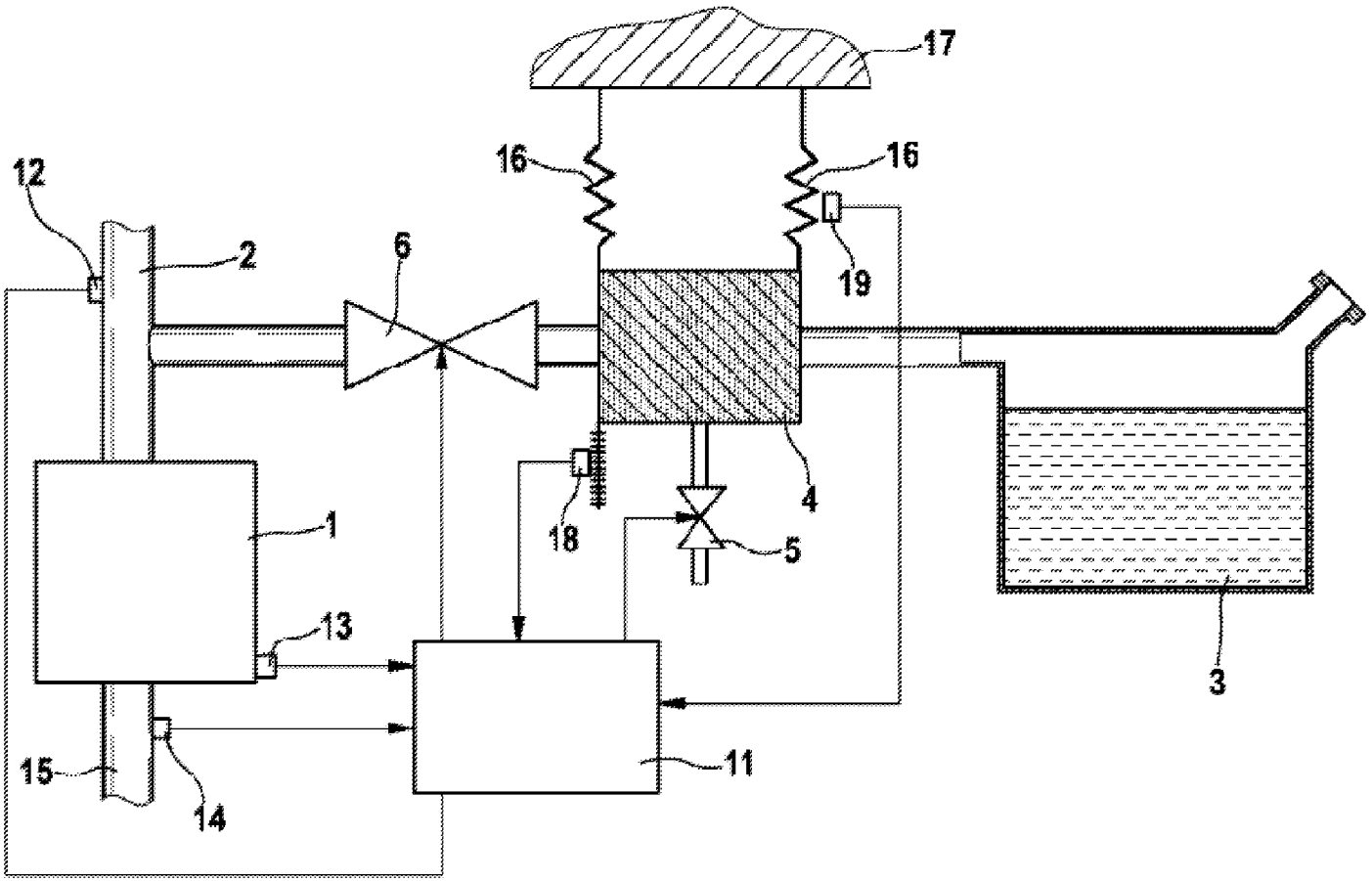

Besides from the components of a common tank venting system as it is shown in FIG. 1, FIG. 2 shows a control unit 11, which serves for controlling the tank venting by opening and closing the mentioned valves 5, 6. For clarity purposes the different elements of the tank venting system in FIG. 2 have the same reference signs as in FIG. 1. The control unit 11 controls the fuel supply from the tank 3 by a fuel metering device 12. The control unit 11 is furthermore supplied with several signals, which characterize the operating status of the combustion engine as well as the fuel air mixture. A sensor that is labeled with 13 is for example illustrated representatively for the detection of the signals that characterize the operating status of the combustion engine. A sensor 14 serves for the detection of the exhaust gas composition in an exhaust gas pipe 15 of the combustion engine.

During the regeneration of the activated carbon filter 4 hydrocarbon vapors get into the inlet manifold 2 of the combustion engine 1 by the above described way and are sucked in by it. In order for providing the correct fuel amount in the combustion engine 1 the injection amount is reduced by the control unit 11 and the fuel metering device 12 is controlled accordingly.

In order to control the operability of the activated carbon filter 4, so that it is ensured that no hydrocarbon vapors are released from the tank 3 into the environment, the existing storage capacity of the activated carbon filter 4 is determined and controlled according to the invention. As a measure for the existing storage capacity an actual filling degree change is determined, which occurs as a result of desorption or adsorption processes at the activated carbon filter 4. From a comparison of the actual filling degree change with a default nominal filling degree change as a measure for the required storage capacity conclusions can be made about whether and/or how much the required operability of the activated carbon filter 4 is given.

The embodiment of a fuel supply system or a tank venting system for implementing the method according to the invention as it is shown in FIG. 2 provides different means for detecting the weight of the activated carbon filter 4, in order to determine the actual filling degree change. These means can be each realized by itself or in combination with each other.

The activated carbon filter 4 is positioned in suspension that is able to oscillate 16, 17. This positioning can for example be realized at a body part 17 by springs 16 as illustrated schematically here. In other embodiments connecting rubber hoses and such alike can be provided instead of the springs. Furthermore a positioning of the activated carbon filter 4 on top of spring elements can be provided instead of suspension that is able to oscillate. For detecting the weight of the activated carbon filter 4 the static alignment of at least one of the springs 16 in the gravitation field can be determined. A path sensor 18 is therefore preferably provided, which determines the alignment of the activated carbon filter 4 in the gravitation field. The load of the activated carbon filter causes a certain mass increase of the activated carbon filter 4. That causes a certain alignment of the hanging activated carbon filter 4 that is able to oscillate, which can be detected by the path sensor 18. For determining this weight force the construction of the motor vehicle is preferably arranged horizontally. In the case of an arrangement of the motor vehicle construction that is not horizontal the determination of the weight force can preferably be corrected, for example based on the tilt angle.

In another embodiment, which is also shown in FIG. 2, it is provided that the activated carbon filter 4 is oscillated. Due to the measurement of the oscillation frequency the total mass of the activated carbon filter 4 is determined. That method can for example be advantageously used if oscillations of the body of the motor vehicle excite the activated carbon filter 4 to oscillate. The determination of the frequency can be detected by a frequency sensor 19. With an increasing load of the activated carbon filter 4 the frequency decreases so that the mass and therefore the load of the activated carbon filter 4 with hydrocarbons can be implied due to the frequency decrease or from the determined frequency compared to a reference value.

For determining the actual filling degree change the determined value is preferably compared to a default reference value. A weight determination of the activated carbon filter 4 can for example be carried out after the tank venting with the regeneration and flushing of the activated carbon filter. The determined value is compared to a reference value, which represents a completely filled activated carbon filter 4. The actual filling degree change results from that difference, which is a measure for the existing storage capacity of the activated carbon filter 4. In another embodiment a weight determination of the activated carbon filter 4 is carried out after a refueling of the motor vehicle and after the tank atmosphere has leveled off. That determined value is compared to a reference value, which represents an emptied activated carbon filter, for example after a tank venting and flushing of the activated carbon filter. From the absolute value of this difference the actual filling degree change can be concluded, which allows conclusions about the present storage capacity of the activated carbon filter 4. From the comparison of the determined actual filling degree change of the activated carbon filter 4 with a nominal filling degree change statements about the operability of the activated carbon filter 4 can be made.

Alternatively or in addition to the described sensor system the actual filling degree change can take place by detecting the remaining oxygen content in the exhaust gas. This takes preferably place by the sensor 14, which detects the exhaust gas composition in the exhaust gas of the combustion engine 1 as a lambda probe. In particular by detecting the deviation of at least one parameter, which is controlled by a lambda regulation, for example the fuel metering, the actual filling degree change can be determined, which is for example based on a desorption of hydrocarbons, which flow off from the activated carbon filter 4 during a tank venting and which is supplied to the combustion engine 1.

Figure 3:
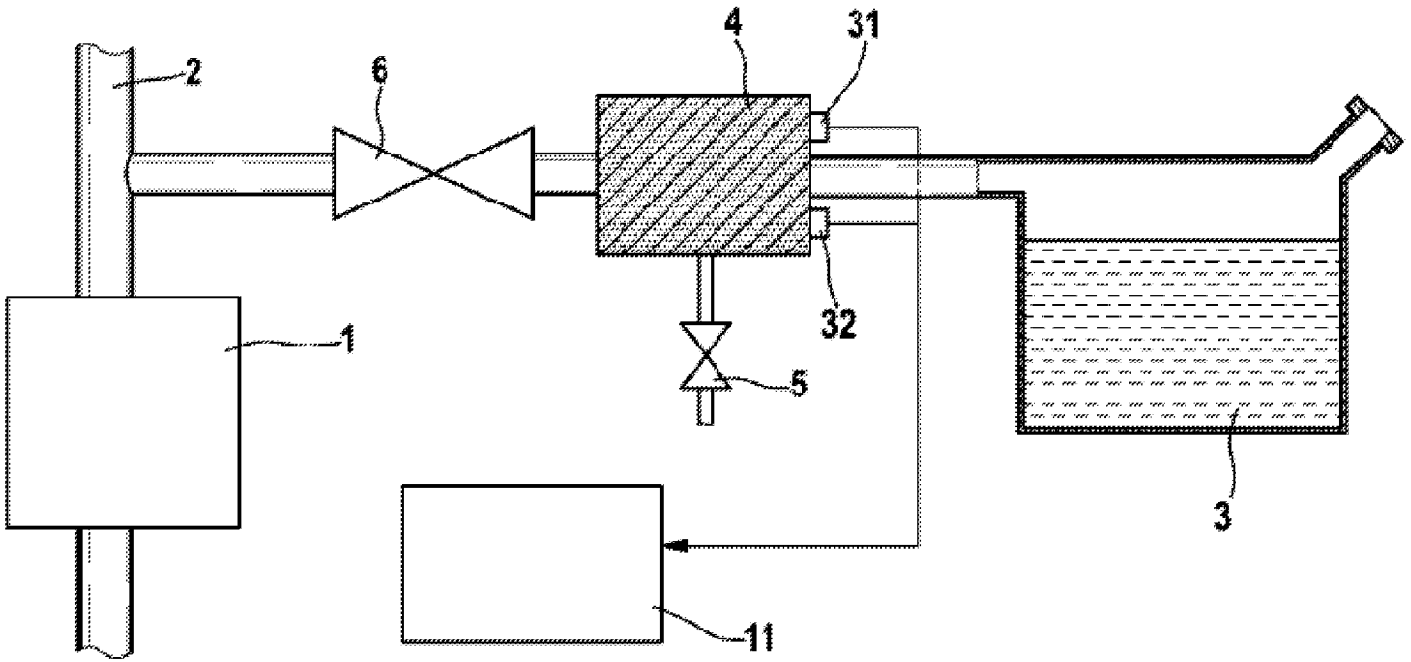

FIG. 3 shows a further tank venting system of a combustion engine 1, which is provided for implementing a further embodiment of the method according to the invention. For clarity purposes the different elements of the tank venting system are labeled with the same reference signs as in FIGS. 1 and 2. For determining the actual filling degree change two temperature sensors 31, 32 are provided, which detect the temperature in the activated carbon filter 4. During the adsorption of hydrocarbons at t activated carbon energy is released in the form of heat. That adsorption heat can be measured with temperature sensors. The load status of the activated carbon filter 4 can therefore be detected by a temperature measurement with the aid of the temperature sensors 31, 32. By a comparison of the temperatures that have been detected by the temperature sensors 31, 32 with suitable reference values the actual filling degree change can be determined, so that the existing storage capacity of the activated carbon filter 4 can be concluded according to the invention and by comparing it with a nominal filling degree change the operability of the activated carbon filter 4 can be assumed. According to the invention it can be provided that several temperature sensors are arranged in the activated carbon filter 4. In other embodiments there is only one temperature sensor provided. The temperature sensor or sensors are advantageously located within the activated carbon filter 4.

The invention claimed is:

1. A system for diagnosing the operability of a fuel vapor intermediate store, the system comprising:

the fuel vapor intermediate store movably connected to an apparatus;

a sensor arranged to measure a degree of movement of the fuel vapor intermediate store; and a controller in electrical communication with the sensor, the controller operative to:

receive an input from the sensor, the input indicating the degree of movement of the fuel intermediate store, and determine operability of the fuel vapor intermediate store based on the input.

2. The system of claim 1, wherein the sensor arranged to measure the degree of movement of the fuel vapor intermediate store comprises the sensor being operative to determine an oscillation frequency of the fuel vapor intermediate store, and wherein the controller operative to determine the operability of the fuel vapor intermediate store comprises the controller operative to:

determine a weight of the fuel vapor intermediate store based on the oscillation frequency, and determine the operability of the fuel vapor intermediate store based on the weight of the fuel vapor intermediate store.

3. The system of claim 2, wherein the controller operative to determine the operability of the fuel vapor intermediate store based on the weight of the fuel vapor intermediate store comprises the controller operative to compare the weight of the fuel vapor intermediate store to a reference value.

4. The system of claim 1, wherein the sensor arranged to measure the degree of movement of the fuel vapor intermediate store comprises the sensor being operative to determine an oscillation frequency of the fuel vapor intermediate store, and wherein the controller operative to determine the operability of the fuel vapor intermediate store comprises the controller operative to determine the operability of the fuel vapor intermediate store based on a change in the oscillation frequency.

5. The system of claim 4, wherein a decrease in the oscillation frequency corresponds to a decrease in the operability of the fuel vapor intermediate store.

6. The system of claim 1, wherein the sensor arranged to measure the degree of movement of the fuel vapor intermediate store comprises the sensor being operative to measure a position of the fuel vapor intermediate store.

7. The system of claim 6, wherein the controller operative to determine the operability of the fuel vapor intermediate store comprises the controller operative to determine the operability of the fuel vapor intermediate store based on the position of the fuel vapor intermediate store.

8. The system of claim 6, wherein the controller operative to determine the operability of the fuel vapor intermediate store comprises the controller operative to:

determine a weight of the fuel vapor intermediate store based on the position, and determine the operability of the fuel vapor intermediate store based on the weight of the fuel vapor intermediate store.

9. The system of claim 6, wherein the controller operative to determine the weight of the fuel vapor intermediate store based on the position comprises the controller operative to correct the weight based on a tilt angle of the apparatus.

10. The system of claim 1, wherein the fuel vapor intermediate store movably connected to the apparatus comprises the fuel intermediate store connect to the apparatus via at least one spring or at least one rubber hose.

11. A method for diagnosing the operability of a fuel vapor intermediate store in a fuel tank venting system, the method comprising:

moveably connecting the fuel vapor intermediate store to an apparatus;

arranging a sensor to detect movement of the fuel vapor intermediate store;

receiving, at a controller, an input from the sensor, the input indicating a degree of movement of the fuel vapor intermediate store;

determining the operability of the fuel vapor intermediate store base on the degree of movement of the fuel vapor intermediate store; and beginning a desorption process, wherein determining the operability of the fuel vapor intermediate store is performed at operating parameters that characterize a high filling degree of the fuel vapor intermediate store before beginning the desorption process.

12. The method of claim 11, wherein receiving the input indicating the degree of movement comprises receiving the input indicating an oscillation frequency of the fuel vapor intermediate store.

13. The method of claim 12, wherein determining the operability of the fuel vapor intermediate store based on the degree of movement comprises:

determining a weight of the fuel vapor intermediate store based on the oscillation frequency, and determining the operability of the fuel vapor intermediate store based on the weight of the fuel vapor intermediate store.

14. The method of claim 12, wherein determining the operability of the fuel vapor intermediate store based on the weight of the fuel vapor intermediate store comprises comparing the weight of the fuel vapor intermediate store to a reference value.

15. The method of claim 12, wherein determining the operability of the fuel vapor intermediate store base on the degree of movement comprises determining the operability of the fuel vapor intermediate store based on a change in the oscillation frequency.

16. The method of claim 15, wherein a decrease in the oscillation frequency corresponds to a decrease in the operability of the fuel vapor intermediate store.

17. The method of claim 11, wherein the sensor arranged to measure the degree of movement of the fuel vapor intermediate store comprises the sensor being operative to measure a position of the fuel vapor intermediate store.

18. The method of claim 17, wherein determining the operability of the fuel vapor intermediate store comprises determining the operability of the fuel vapor intermediate store based on the position of the fuel vapor intermediate store.

19. The method of claim 18, wherein determining the operability of the fuel vapor intermediate store comprises:

determining a weight of the fuel vapor intermediate store based on the position; and determining the operability of the fuel vapor intermediate store based on the weight of the fuel vapor intermediate store.

20. The method of claim 18, wherein determining the weight of the fuel vapor intermediate store based on the position comprises the controller operative to correct the weight based on a tilt angle of the apparatus.

* * * * *